United States Patent [19]

Farnand

[11] Patent Number: 4,888,108

[45] Date of Patent: Dec. 19, 1989

[54] SEPARATION OF FINE SOLIDS FROM PETROLEUM OILS AND THE LIKE

[75] Inventor: J. Redmond Farnand, Ottawa, Canada

[73] Assignee: Canadian Patents and Development Limited, Ottawa, Canada

[21] Appl. No.: 220,934

[22] Filed: Jun. 23, 1988

Related U.S. Application Data

[63] Continuation of Ser. No. 836,427, Mar. 5, 1986, abandoned.

[51] Int. Cl.[4] ..... C10G 1/04

[52] U.S. Cl. ..... 208/424; 208/177; 208/180

[58] Field of Search ..... 208/424, 391, 435, 426, 208/177, 179–181

[56] References Cited

U.S. PATENT DOCUMENTS

| | | | |
|---|---|---|---|
| 3,816,305 | 6/1974 | Schutte | 208/424 X |
| 4,029,567 | 6/1977 | Farnand et al. | 208/426 |
| 4,040,957 | 8/1977 | Sze et al. | 208/424 X |
| 4,057,486 | 11/1977 | Meadus et al. | 208/426 X |
| 4,075,080 | 2/1978 | Gorin | 208/426 X |
| 4,079,004 | 3/1978 | Tan et al. | 208/424 X |
| 4,094,781 | 6/1978 | Snell et al. | 208/424 X |
| 4,132,039 | 1/1970 | Katz et al. | 208/424 X |
| 4,154,670 | 5/1979 | Forsberg | 208/181 X |
| 4,312,747 | 1/1982 | Gatsis | 208/435 X |
| 4,476,012 | 10/1984 | Gatsis | 208/424 X |
| 4,670,104 | 6/1987 | Taylor | 208/424 X |

*Primary Examiner*—Glenn Caldarola
*Attorney, Agent, or Firm*—Alan A. Thomson

[57] ABSTRACT

Dispersed solids, particularly fine peptized hydrophobic solids, present in some petroleum oils, bitumen solutions or concentrates, heavy oils and the like, may be removed by distributing an additive selected from resorcinol, catechol, formic acid, maleic acid or anhydride, chloral hydrate and asphaltene - precipitating solvents (preferably certain mixtures thereof) throughout the dispersion to cause small agglomerates containing the solids to form, and separating the agglomerates from the residual liquid. This residual liquid is rendered more suitable for various refining processes. Agglomerates containing asphaltenes and mineral solids may be used e.g. in hydrogen generation, for compounding roofing materials and in paving materials.

11 Claims, 1 Drawing Sheet

SEPARATION OF FINE SOLIDS FROM PETROLEUM OILS AND THE LIKE

This application is a continuation of application Ser. No. 06/836,427, filed Mar. 5, 1986, now abandoned.

This invention relates to the removal of fine peptized solids from various bitumen solutions or concentrates, heavy petroleum oils and the like by a specific agglomeration technique. Bitumen solutions e.g. derived from Alberta tar sand processing, and heavy oils e.g. from Cold Lake Alberta or Lloydminster Saskatchewan are of particular interest as feed material.

Bitumen solutions derived from solvent extracted oil sands usually contain significant quantities of finely dispersed solids (Ignasiak, T. M., Kotlyar, L., Longstaffe, F. J., Strausz, O. P., and Montgomery, D. S., Separation of Clay from Athabasca Asphaltene, Fuel, 62, 353-362, (1983). The extent of the solids depends largely on the type of feed material and the method of contact with the extracting solvent (Meadus, F. W., Bassaw, B. P. and Sparks, B. D., Solvent Extraction of Athabasca Oil Sand in a Rotating Mill. Part 2. Solids-Liquid Separation and Bitumen Quality, Fuel Processing Technology, 6, 289-300, (1982). The lower grade bitumen feeds contain higher percentages of clay resulting in higher amounts of intractable solids in the bitumen solution. Because of the adverse effect of fine solids on the upgrading process, refineries normally apply a specification of no more than 1.0% to the ash content of feedstocks.

The intractable solids, essentially non-settling, are characterized by fine particle size and a hydrocarbon coating. These solids after extensive extraction with toluene have been shown to contain up to 60% organic carbon. This hydrophobic carbonaceous coating is consideraby more soluble in solvents such as methanol and acetone, indicating a more polar character compared to bitumen itself. Infra-red and NMR spectra of the coated solids indicate a complex hydrocarbon structure containing carboxylic acid and sulfonate groups (coating) overlaying a clay (kaolin) matrix. One proposed structure has fulvic acid-like molecules bonded to the substrate through heavy metal atoms adsorbed on or substituted into the clay lattice in clay tailings (Kessick, M. A., Structure and Properties of Oil Sands Clay Tailings, J. Can. Petrol. Technol., 18, 49-52, (1979)). The suspension stability apparently results from fine particle size and strong interaction between the particle coating and components of the dissolved bitumen. Clementz and others also found that montmorillonite and other types of clay absorbed the heavy ends and became hydrophobic (Clementz, D. M., "Interation of Petroleum Heavy Ends with Montmorillonite", Clays and Clay Minerals, 24, 312-319, (1976). Clementz, D. M., "Alteration of Rock Properties by Adsorption of Petroleum Heavy Ends: Implications for Enhanced Oil Recovery", SPE/DOE 10683, (1982). Czarnecka, E. and Gillott, J. E., "Formation and Characterization of Clay Complexes and Bitumen from Athabasca Oil Sand", Clays and Clay Minerals, 28, 197 208, (1980)). These intractable solids are very difficult to remove by filtration and require extensive centrifugation to bring the solids content of the bitumen solution down to acceptable levels.

In U.S. Pat. No. 3,268,071, Aug. 23, 1966 Example X, the agglomeration of the oil phase from an aqueous dispersion of tar sands is described (these agglomerates still contained 26-28% sand). U.S. Pat. No. 4,057,486

Nov. 8, 1977 describes the agglomeration of mineral solids from organic solvent or diluent dispersions containing tar sands or oil shale, using about 8-50% wt. (based on the feed) of aqueous agglomerating liquid. As indicated in Table 1 up to 2.5% of solids (sand) remained with the solvent phase, depending on the amount of settling allowed. It would be desirable to remove increased amounts of these intractable solids.

In the recovery of bitumen from oil sands by the SESA process (solvent extraction solids agglomeration) described in U.S. patent application No. 06/870,422 filed 4 June 1986, now U.S. Pat. No. 4,719,008, the solvent bitumen mixture after being separated from the bulk solids contains 0.4 to greater than 1% intractable solids depending on the feed type and operation conditions. Expressed on the bitumen component alone, this solids content varies from about 1.3 to 4%. The amount of solids in the bitumen extract increases with the fines content ($-44$ $\mu$m) in the original oil sands feed. The hydrophobic nature of these fine solids prohibits them from being agglomerated with the main body of the water wetted solids in the SESA process. The present invention in one aspect provides for the substantial removal of the intractable solids from bitumen solutions produced by the SESA process.

SUMMARY OF THE INVENTION

In this invention, the fine solids are removed from the bitumen solution, heavy oil or the like by a procedure involving agglomeration of the solids followed by removal of the agglomerates e.g. by gravity settling-/decantation, screening etc. Conventional wetting agents are usually surface-active agents with a propensity of markedly reducing interfacial tension at low concentrations. Introduction of such agents into the suspensions treated in this work usually resulted in the formation of stable emulsions with little separation of solids. However, it has been found that certain low molecular weight, water-soluble organic compounds have an affinity for the hydrocarbon-coated solids in oil suspension, allowing these particles to be collected by an aqueous solution of the reagent. A list of the preferred characteristics found for these agglomerating agents is shown below.

(1) High solubility in water.

(2) Low miscibility with hydrocarbon solvents alone, or in the presence of water.

(3) Contain carboxylic acid and/or hydroxyl groups.

(4) Have weakly acidic and/or polar character.

Figure 1:
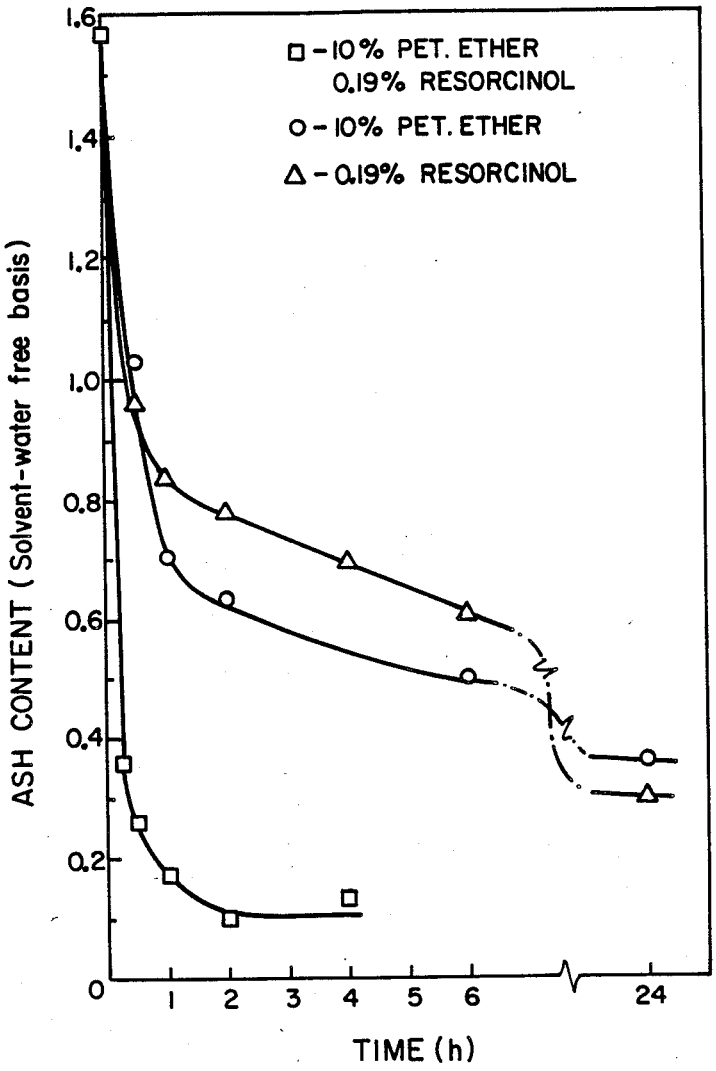
FIG. 1 is a graph showing the reduction of ash content of bitumen solution with time for treatment with precipitating solvent and additive alone, and together.

A few selected additives have been found to cause the desired agglomeration i.e. resorcinol, catechol, formic acid, maleic acid or anhydride, chloral hydrate and asphaltene-precipitating solvents. Mixtures of the asphaltene-precipitating solvent and one of the other additives (or other polar organic compound having the above characteristics) have been found most effective when asphaltenes are present in the feed material.

The invention includes a process of reducing the solids content of petroleum oils, bitumen solutions or concentrates, or heavy oils and the like, containing intractable fine hydrophobic solids, comprising:

dispersing an additive throughout the solids-containing feed material, said additive being selected from the group consisting of resorcinol, catechol, formic acid, maleic acid or anhydride, chloral hydrate and asphaltene-precipitating solvents, and mixtures thereof, in an amount sufficient to cause small agglomerates comprising the hydrophobic solids to form; asphaltenes being present when asphaltene-precipitating solvents are selected and water being present when the other additives are selected; and removing the agglomerated solids from the residual liquid.

The agglomerates comprising the fine mineral solids and asphaltenes precipitated on the surfaces of said solids, are believed to be novel and are part of the invention. They are useful as components in roofing materials (tar, shingles, repair compounds) and paving materials. Also they may be used in hydrogen production processes such as the Kashima/Toyo process described in "Chemical and Engineering News" Oct. 10, 1983 page 25; or burned for heat value e.g. in a fluidized bed combustor. These agglomerates usually are formed in a size range of about 0.2 to about 2 mm. diam. but other sizes are possible by manipulation of variables.

The effective amounts of additive usually will be within the range about 0.5 to about 3% W/W based on the feed material (except for the asphaltene-precipitating solvent which usually is used within the range of about 10 to about 40% and recycled).

The asphaltene-precipitating solvents are selected from aliphatic solvents having up to about eight carbon atoms. Suitable solvents include petroleum ether, pentane, hexane, octane, and their corresponding isomers. Light ends from upgrading plants or refineries could also serve as suitable precipitating solvents, especially the low boiling fraction of Syncrude naphtha or other low boiling paraffinic cut.

This aspect allows precipitation of the most polar and highest molecular weight portion of asphaltenes, which in turn has been found to act as a bonding agent between the suspended solids with the attendant agglomeration and settling of the solids. The most undesirable portion of the asphaltenes was found to be removed. This portion also contained the highest amount of metal organic compounds. It follows that a portion of the undesirable hetero-atoms (N, S, O) was removed also. Such a treated bitumen product will constitute an improved feed for upgrading plants. The quality of the feed will improve with the amount of precipitating solvent used.

The most preferred embodiment of the invention is the concurrent use of both an asphaltene-precipitating solvent (when asphaltenes are present) and a polar compound characterized by high water solubility and low miscibility with hydrocarbon solvents.

It was found that the effective concentration required for each component was reduced so significantly that the amount of each additive needed was well below the effective levels required when using either component alone (this is believed to be a synergistic effect). Thus concurrent use of about 5 to 10% solvent plus about 0.2 to 0.5% polar additive (W/W of the feed) was found very effective.

The precipitating solvent method is particularly advantageous for the SESA (solvent extraction spherical agglomeration) process liquors not only because of the low levels of water (<1%) required but also because economics probably would dictate the use of synthetic naphtha type solvents in any SESA process commercial operation. These synthetic naphthas have a high content of short chain aliphatic hydrocarbons that contribute appreciably to the subsequent asphaltene precipitation thereby requiring less precipitating solvent to displace a given amount of asphaltenes. A typical synthetic naphtha contains about 6% aromatics, 25% naphthenes, and 69% paraffins of which n-pentene and n-hexane make up 22% and 14.5% respectively. Because of the presence especially of the latter two paraffins, in a SESA feed liquor, less precipitating solvent is required to cause the asphaltenes to agglomerate and precipitate the peptized solids in this case.

As well as tar sand solvent extraction liquors, this invention is applicable to bitumen concentrates from oil sand hot water extraction processes, various heavy oils including shale oil, and oils obtained from enhanced oil recovery techniques such as steam injection. A preferred feed material is a tar sand solvent extraction-spherical agglomeration process liquor. Even conventional crude oils containing significant amounts of clay solids can be treated.

When the additive is resorcinol, catechol, formic acid, maleic acid or anhydride or chloral hydrate, some water must be present (or to be added) for effective solids agglomeration. Amounts of water in the range of about 0.5 to about 3% w/w of the feed are preferred. In some cases it will be desirable to incorporate these additives as a concentrated aqueous solution, preferably a saturated solution. When asphaltene-precipitating solvents are used alone, it has been found preferable that the system contain only its natural water content i.e. have no additional water added.

Many additives were tested before the fully effective ones were identified. It was not possible to predict the most effective ones. It is preferred to select the most effective or economical one for each feed material.

The following examples are illustrative.

In the experiments with polar additives, water solutions of many different types of chemical additives were added to jars containing 20 to 50 g of bitumen concentrates. The mixtures were then agitated fairly vigorously in a Spex (TM) shaker for 3 minutes to promote rapid dispersion of the additives. This was followed by more gentle agitation in a paint shaker for an additional 6 minutes in order to promote agglomeration of the mineral particles. The mode of agitation did not appear to be important except that vigorous agitation followed by a milder form improved settling rates slightly. The suspensions were than allowed to settle for given time intervals of 15 minutes up to 24 hours depending on the rate of settling achieved. In the case of precipitating solvent addition, selected solvents were added to the liquors in order to precipitate the asphaltenes on the mineral particles. In this case, mild agitation alone appeared to give the best results. Agitation was thus accomplished by rotating the partially-filled jars at about 90% of the critical speed for about 9 minutes (the critical speed is that at which the contents follow the rotating vessel walls thru 360°). Milder agitation encouraged the loosely formed asphaltene-mineral agglomerates to coalesce and weld into larger sizes with less risk of disintegrating. In the case of mixed polar agents and solvents, the polar agents were added first followed by 3 minutes agitation in a Spex shaker. Subsequently a precipitating solvent was added followed by 6 minutes agitation in a paint shaker. In all cases the treated suspensions were allowed to settle by gravity. Samples were drawn off from the supernatent layer at chosen intervals and ashed at 500° C. to determine the solids content. The water content in the bitumen concentrates was determined by the Dean and Stark method.

Bitumen concentrates used in these tests were produced by the SESA solvent extraction bench-scale unit a NRC and by the Syncrude Hot Water flotation plant. The latter product was limited to a single 3 liter sample. The SESA material was produced from different types of oil sands starting materials which were all high in fines content; of brief continuous settling step removed the bulk of the coarse suspended material during collection. In addition, a composite sample was used. The identities and compositions of the bitumen concentrates are given in Table 1.

EXAMPLE 1

SESA LIQUORS

The effect of different types of additives on SESA process bitumen extract is shown in Table 2A. They represent only a cross section of the many additives tested, and are given here for comparison purposes. In general, screening was carried out with many low molecular weight polar compounds possessing high water solubilities. These additives were composed of alcohols, bases, acids, ketones, aldehydes, phenols, and other types of additives with appropriate functional groups. It was found that useful additives were soluble to concentrations of at least 20% in water. The most difficult bitumen concentrate-B (Conditioning Drum Oversize) was used in the test results in this Table 2A. These results may be compared with the effective additives of Table 2B.

Results given in Table 2B compare 6 treating agents found effective for SESA process liquors after a two hour settling period. Two different concentrations of additives were used in each case. Formic acid, maleic acid and chloral hydrate in amounts of about 2% were all effective additives for the four SESA product liquors. Resorcinol (1,3-dihydroxybenzene) in less than one-fifth the concentration (0.37%) of the other polar type additives was found the most effective. The better results obtained with resorcinol may have resulted from the acid hydroxyl groups and its extremely high water solubility as well as its insolubility in bitumen components. All the additives in Nos. 3–9 were added as 50% w/w solutions. Catechol (No. 10) was added as a 30% solution because of its lower solubility in water. Catechol (1,2-dihydroxybenzene) was probably less effective than resorcinol because of its lower water solubility and the lower reactivity of the hydroxyl groups. The remaining dihydric phenol (1,4-dihydroxybenzene) has a solubility of only 5.9 g in 100 cc of water, and was therefor not used. It is noteworthy that all polar wetting agents were less effective in product B (Conditioning Drum Oversize) than on the other SESA liquors. Because of its history, this material is not only higher in solids but also contains a proportionately greater amount of hydrophobic fines compared to other product liquors, therefore making wetting with polar agents more difficult.

Precipitation of asphaltenes with pentane (Table 2B Nos. 11 and 12) was an effective method for reducing solids in SESA product-liquors. The water content of these liquors (<0.4%) was not high enough to promote any appreciable amount of emulsion formation with the precipitated asphaltenes. Product B was more amenable to agglomeration by the asphaltene-precipitation method than by the use of polar additives. For example 40% pentane (not shown) reduced the solids content to <0.1% in 15 minutes settling. Therefore, agglomeration of the mineral matter by asphaltenes is probably equally effective for both hydrophobic and hydrophilic minerals. The two hour settling period used in this Table 2B was longer than necessary for some of the examples given (see time dependency in Tables 4A and 4B).

EXAMPLE 2

The effect of additive concentration and time on the removal of solids from SESA process liquor D-1, is shown in Table 3A. This material was low in solids (0.52%), but was chosen because of the availability of a large sample. All additives with the exception of petroleum ether were added in the form of 50% aqueous solutions. From the control (No. 1), it is shown that 0.22% solids or 42% approximately of the initial solids still remain in suspension after a 24 hour settling period. Formic acid (Nos. 2–5) required concentrations of 1.5 to 2.0% in order to be effective in short time periods. Chloral hydrate (Nos. 6–8) was about as effective as formic acid. As noted previously, resorcinol (Nos. 9–13) required much lower concentrations than any of the other polar additives tested. Petroleum ether (P.E.) with the boiling point range of 30°–60° C. was found to be slightly more effective than pentane for precipitating asphaltenes from SESA process liquor. It was therefore used in the remainder of the asphaltene-precipitation experiments. Nos. 14–20 show the effect of different concentrations of P.E. on the removal of solids. Concentrations in the range of 20 to 40% based on the SESA liquor or 60 to 110%, based on the bitumen content, produced fairly rapid settling rates.

In No. 16, the D-2 SESA liquor was used. This product contained only 24.1% bitumen. The treatment with only 10% P.E. produced settling rates at least as fast as 15% P.E. did with the 33% bitumen concentration in the D-1 SESA product. The lower amount of P.E. required for the more dilute bitumen solution reflected the higher content of low molecular weight aliphatic compounds present in the synthetic naphtha, as well as the lower viscosity of the suspending medium. When No. 17 possessing only 15% P.E. (insufficient for gravity settling) was repeated and mildly centrifuged, the solids in the supernatant liquid were reduced to 0.08% in about 15 minutes. This result would indicate that the centrifugal action produced by hydrocyclones would be adequate to effect rapid separations with fairly low amounts of precipitating solvent. The remainder of Table 3A deals with the joint use of polar additives and a precipitating solvent. When these additives are used together, a synergistic effect occurs permitting a considerable reduction in both types of additives. For instance, in No. 21, it is shown that 5% P.E. and less than 0.1% resorcinol reduced the solids to less than 0.1% in a 6 hour period. This is about as effective as 20% P.E. alone (factor of four) or 0.375% resorcinol (factor of four also). However, doubling both types of additives (No. 22) resulted in more practical settling times. When either formic acid or chloral hydrate (Nos. 24 and 25) was used in conjunction with only 10% P.E., 1/10 as much of these polar additives was required to produce a similar settling rate (compare with Nos. 5 and 8). Unexpectedly, the water soluble organic acids (acrylic-26, acetic-28, lactic-29) which had a limited effect when used alone, were almost as effective in combination with P.E. as any of the effective polar additives were in combination with P.E. This would indicate that these acid preferentially associate with the asphaltene component of the bitumen. Polymerized acrylic acid, No. 27, had no significant effect. Methyl alcohol (No. 30) which showed no significant improvement when used alone (Table 2A), had a slight favourable effect when used in combination with P.E.

The amount of precipitating solvent can therefore be decreased several fold by the use of preferably about 0.1 to 0.2% of a suitable water soluble polar additive. It is possible that as asphaltenes are precipitated from the bitumen solution, they are preferentially attracted to polar additive already absorbed on the mineral surfaces. A "push-pull effect" may therefore result. That is, the asphaltenes are being pushed out of solution by the aliphatic solvent and at the same time are being pulled onto the mineral surfaces by adsorbed polar compounds. This phenomenon probably results in a greater buildup of precipitated asphaltenes on the mineral surfaces.

Results obtained indicate a marked dependence on the amount of additive used, as shown in Table 3A, 1–5 and 9–13 which compares results for formic acid and resorcinol after 30 minutes settling. Although both of these additives are ultimately equally effective, a significantly greater concentration of formic acid is required. This is because, compared to resorcinol, formic acid is considerably more soluble in the bitumen solution, thus resulting in greater diffusion of this additive throughout the continuous phase. Consequently, the concentration of the additive in the dispersed aqueous phase is decreased, causing a reduction in its ability to collect suspended particles, until a miscibility balance is set up.

The mechanism of collection possibly comprises the formation of a fine dispersion of the aqueous phase under high-shear agitation conditions, followed by contact and adhesion between the suspended particles and these droplets in an analogous manner to emulsion flotation. Because of the affinity between the dissolved additive and the polar hydrocarbon coating of the particles, the solids will tend to remain at the hydrocarbon-aqueous interface to be absorbed into the droplets. Reduction in the degree of agitation allows coalescence of the solids-rich droplets and thus, improved sedimentation rates.

Because the reagents are not surface-active it usually is necessary to have high solution concentrations in order to ensure that an adequate amount of the agent is present at the interface where contact with suspended particles occurs. Thus, when determining reagent requirements the amount of solution added may be changed rather than the concentration of reagent.

The use of anti-solvent agglomeration to remove solids has been shown to be effective to this situation. When an anti-solvent such as pentane or hexane, was added to the suspension, the precipitation of asphaltenes occurred. Fine solids in suspension acted as nuclei for the precipitating asphaltenes and the surface coating formed provided a bonding medium between particles, resulting in the formation of agglomerates with an increased sedimentation velocity. This effect has been achieved with naphtha solutions of bitumen as shown in Table 3A. For this particular system a 30°–60° C. petroleum ether has been found to be more effective than pentane. Again the ash levels attainable were very dependent on the quantity of anti-solvent added. This is illustrated by Table 3A Nos. 15–20, which shows ash content, after 30 minutes settling, as a function of added petroleum ether. The amount of anti-solvent used is presented as a weight precentage of the original suspension treated. The quantity of asphaltene precipitated increased with the amount of anti-solvent used, and the greater availability of this particle coating agent resulted in larger agglomerate size and more rapid settling. Addition of an asphaltene solvent, such as toluene, instead of the non-solvent resulted in only a marginal improvement in settling rate, presumably due to viscosity reduction.

Both of the individual treatments proved to be quite capable of removing solids to a satisfactory degree as shown in Tables 2B and 3A Nos. 1–20. However, the reagent consumption necessary to achieve a rapid rate of sedimentation was quite high. Although an anti-solvent would be relatively easy to recover during subsequent bitumen upgrading steps, the polar additives would present more of a problem if recycling became necessary. As a result of these tests it is clear that polar additive consumption could be reduced by co-addition with an anti-solvent. A typical result is shown in FIG. 1 (derived from Table 3A Nos. 10, 15 and 22) where a combination of resorcinol and petroleum ether was used. It is apparent that some form of enhanced effect results from the combination of treatments, with both the settling rate and the final ash level being significantly improved, compared to the individual treatments.

Another unexpected result of the combined treatment was that the system response to a number of normally weakly active agents was significantly enhanced. Results for several such compounds are shown in Table 3A Nos. 26–30. In the absence of an anti-solvent the same concentrations of these reagents would have given results only marginally better than the control run where no treatment was used. Similarly, at the 10% level, anti-solvent alone gave only a marginal improvement over the control. The combination of treatments thus allows a wider selection of reagents to be used, an important consideration from an economic viewpoint.

EXAMPLE 3

HOT WATER PROCESS FROTH

An attempt was made to remove the solids from a froth flotation concentrate sample which originated at Syncrude (Alberta). This bitumen concentrate had the following composition: bitumen, 38.5%; water, 56.1%; solids, 5.4%. A high proportion of water was occluded and easily removed. About 86% of the total water containing about 0.2% solids was removed by agitating this material in a glass jar in a Spex (TM) shaker. Three successive three minute periods were used with the displaced water being removed after each cycle. This upgraded bitumen concentrate (S.B.-C) now contained 74.4% bitumen and the water and mineral components were 18.8% and 6.8% respectively.

The (S.B.-C) material was then diluted with both toluene and Syncrude naphtha to make the organic phase composition about 32% bitumen, 10% toluene and 58% Syncrude naphtha. The toluene was added to prevent any asphaltenes from precipitating, thus avoiding emulsification in the presence of the still high water content. After mixing all the ingredients for 10 minutes in a paint shaker, the mixture was allowed to settle for 3 hours at room temperature. The supernatent bitumen solution (S.B.-D), now partially dewatered and partially demineralized, was found to contain about 1.1% water and 1.3% ash. Aliquots of this (S.B.-D) material were subsequently treated with polar agglomerating agents and a precipitating solvent. Results are shown in Table 3B.

The slow settling rate for untreated (S.B.-D) material is shown in Table 3B No. 31. The addition of 50–60% P.E. produced rapid settling rates. Greater amounts of P.E. were required than for the SESA product of similar bitumen concentration. This greater amount of precipitating solvent reflects the additional amount required in order to offset the presence of aromatic toluene. Also, emulsified water if present, would tie up clay perhaps in the form of clay films and slow down the settling rate. The polar additives e.g. Nos. 34–36 were all added in high solution concentrations (70% additive–30% water) in order to add little additional water to the 1.1% water contained in the (S.B.-D) material. Here again, resorcinol was the most effective polar additive but requirements were high for all three polar additives. The higher additive requirements may again be owing to the presence of some emulsified water. It is possible that the joint use of a suitable demulsifier and agglomerating agent might increase the settling rate of the solids in this material. The bulk of the water may also be better removed at elevated temperatures, or by other methods.

EXAMPLE 4

In Table 4, the amount of agglomerate residue, its composition and the asphaltene distribution are given for SESA product liquor D-1 treated with P.E. alone and P.E. in combination with selected polar additives. In Table 4 No. 1, no additive was used, but the liquor was centrifuged several hours in order to obtain a well consolidated agglomerate residue. By this method, the residue was found to be about 1.7% of the original SESA liquor and contained only about 2% of the asphaltenes. In the remaining five experiments, the residues were obtained by gravity settling and were, therefore, not directly comparable to No. 1. In No. 2, 40% P.E. based on SESA liquor was used as a precipitating solvent. The precipitating solvent produced a much larger residue (6.1%) which contained about 37% asphaltenes and 31.9% of the total asphaltenes. The solids content of the residue was only about 8.5%. With this high amount of asphaltenes in the residue, it is reasonable to expect that most of this material does not precipitate directly on the mineral surfaces, but precipitates randomly in the liquor. On settling, these solid-free asphaltenes may eventually form bridges between the mineral particles. All results in Table 4 were based on newly formed agglomerate residues. After separation, the newly formed residue can be sintered and the organic portion reduced considerably without any loss of solids by: (1) allowing it to stand at room temperature for time periods up to 4 hours, (2) allowing it to stand at about 40° to 50° C. for about ½ hour, (3) mild centrifuging for a few minutes. For example, when a SESA residue which had been obtained by treatment with 40% P.E. (similar to No. 2) was allowed to stand 2 hours at room temperature, about 39% of its weight was exuded in the form of a mobile liquid. This organic composite material contained only about 0.08% ash.

When 20% P.E. was used as a precipitating solvent (No. 3), the asphaltene content of the residue (25.5%) was still high and represented about 20.5% of the total asphaltenes. When insufficient precipitating solvent was added to bitumen or bitumen solutions to precipitate all the aphaltenes, only the higher molecular weight fraction precipitated. It has been established that the higher molecular weight fractions are preferentially attracted to the clay. This asphaltene component also contained a high proportion of the inherent ash, i.e. nickel, vanadium, iron, etc., in the form of chelate structures. Some of these metals especially nickel and vanadium act as catalyst poisons in refining operations. The removal of the high molecular weight fraction of the asphaltenes from the bitumen solution will reduce the metals and minerals as well as the hetero-atoms (N, S, O) which are also relatively enriched in this fraction, thus providing an improved feed for the subsequent upgrading operation.

In the resorcinol treated liquor (No. 4), only 4.1% of the original asphaltenes were found in the residue. With the joint addition of both P.E. and appropriate polar additives (Nos. 5–7), only 7 to 9% of the total asphaltenes reported with the residue. Therefore the synergistic effect noted earlier with this combination of precipitating solvent and polar additive is not because of excessive asphaltene-precipitation but probably owing to a high proportion of precipitated asphaltenes being attracted to the mineral surfaces as a result of the adsorbed polar additives.

TABLE 1

| | | COMPOSITION OF BITUMEN SOLUTIONS | | | | |
|---|---|---|---|---|---|---|
| Sample No. | Origin | Diluent | Bitumen Conc. w/w % | Water Content w/w % | Solids** Content w/w % | Feed Material |
| A | SESA | Varsol | 27.5 | 0.14 | (4.65) 1.28 | Medium Grade (22% < 325 mesh) |
| B | SESA | Suncor Naphtha | 33.0 | 0.31 | (5.03) 1.66 | Conditioning Drum Oversize (49% < 325 mesh) |
| C | SESA | Suncor Naphtha + Varsol | 32–33 | 0.24 | (4.00) 1.3 | Composite (27% < 325 mesh) |
| D-1 | SESA | Suncor Naphtha | 33.2 | 0.37 | (1.57) 0.52 | Medium grade (30% < 325 mesh) |
| D-2 | SESA | Suncor Naphtha | 24.1 | 0.30 | (2.82) 0.68 | As in D-1, but more dilute |
| S.B.* | H.W. | (as supplied) | 38.5 | 56.1 | (14.03) 5.4 | Flotation Conc. |
| S.B.-D++ | H.W. | S.B.-Diluted | 32.0 | 1.1 | (4.06) 1.3 | (S.B. diluted and settled) |

*Syncrude Bitumen (S.B.) flotation product from the Hot Water (H.W.) process.
++S.B.-D. = S.B.-Diluted with Syncrude Naphtha + Toluene, partially dewatered and partially demineralized.
**Solids content in brackets are on solvent/water free basis

TABLE 2A

EFFECT OF SOME DIVERSIFIED ADDITIVES ON SOLIDS IN B CONCENTRATE*

| No. | Additive | % Additive | Solids Content** |
|---|---|---|---|
| | Control | Nil | 1.1 (3.33) |
| 1 | Acetic Acid | 3% | 0.65 (1.97) |
| 2 | Acrylic Acid | 3% | 0.50 (1.52) |
| 3 | Polyacrylic Acid | 3% | 0.76 (2.30) |
| 4 | Oxalic Acid | 0.6% | 0.64 (1.94) |
| 5 | Malonic Acid | 3% | 0.50 (1.52) |
| 6 | Glycollic Acid | 2.0% | 0.58 (1.76) |
| 7 | Lactic Acid | 2.0% | 0.62 (1.88) |
| 8 | Tannic Acid | 3% | 0.78 (2.36) |
| 9 | Pyruvic Acid | 3% | 0.66 (2.00) |
| 10 | Benzene Sulfonic Acid | 2.5% | 0.22 (0.67) |
| 11 | Sulfamic Acid | 2.0% | 0.63 (1.91) |
| 12 | Hydrofluoric Acid | 2.0% | 0.11 (0.33) |
| 13 | Ammonia | 3% | 0.62 (1.88) |
| 14 | Methanolamine | 3% | 0.35 (1.06) |
| 15 | Sodium Silicate | 3% | 1.1 (3.33) |

TABLE 2A-continued

EFFECT OF SOME DIVERSIFIED ADDITIVES ON SOLIDS IN B CONCENTRATE*

| No. | Additive | % Additive | Solids Content** |
|---|---|---|---|
| 16 | Sodium Hydroxide | 2% | 0.78 (2.36) |
| 17 | Methyl Alcohol | 3% | 0.82 (2.48) |
| 18 | Allyl Alcohol | 3% | 0.64 (1.94) |
| 19 | Tetrahydrofurfuryl Alcohol | 3% | 0.74 (2.24) |
| 20 | Furfuryl Alcohol | 3% | 0.62 (0.88) |
| 21 | Sulfur Dioxide | 0.5% | 0.86 (2.61) |
| 22 | Formaldehyde | 3% | 0.72 (2.18) |
| 23 | Urea | 3% | 0.76 (2.30) |
| 24 | Ethyl Urea | 3% | 0.71 (2.15) |
| 25 | 4-Hydroxypyridine | 3% | 0.61 (1.85) |
| 26 | Hydroxybutanone | 3% | 0.94 (2.85) |
| 27 | Pyridine methanol | 3% | 0.67 (2.03) |
| 28 | Methyl Acetoacetate | 3% | 0.79 (2.39) |
| 29 | Acetonitrile | 3% | 0.68 (2.06) |

*2 hour settling period
**Solids content in brackets are on solvent/water free basis.

TABLE 2B

EFFECT OF SELECTED ADDITIVES ON SOLIDS REMOVAL FROM SESA PRODUCT LIQUORS

| No. | Additive | % Additive | Solids Content* - 2 Hrs. Settling A | B | C | D-1 |
|---|---|---|---|---|---|---|
| | | | (4.7) | (5.2) | (4.0) | (1.57) |
| 1 | Original | Not Settled | 1.3 | 1.7 | 1.3 | 0.52 |
| | | | (3.20) | (3.33) | (1.97) | (1.08) |
| 2 | Control | Nil | 0.88 | 1.1 | 0.64 | 0.36 |
| | | | (0.15) | (0.58) | (0.34) | (0.15) |
| 3 | Formic Acid | 2% | 0.04 | 0.19 | 0.11 | 0.05 |
| | | | (0.47) | (1.58) | | (0.36) |
| 4 | Formic Acid | 1% | 0.13 | 0.52 | — | 0.12 |
| | | | (0.25) | (0.48) | | (0.24) |
| 5 | Maleic Acid | 2% | 0.07 | 0.16 | — | 0.08 |
| | | | (0.40) | (0.67) | (0.46) | (0.18) |
| 6 | Chloral Hydrate | 2% | 0.11 | 0.22 | 0.15 | 0.06 |
| | | | | | | (0.45) |
| 7 | Chloral Hydrate | 1% | — | — | — | 0.15 |
| | | | | (0.64) | (0.28) | (0.18) |
| 8 | Resorcinol | 0.37% | — | 0.21 | 0.09 | 0.06 |
| | | | | | | (0.78) |
| 9 | Resorcinol | 0.19% | — | — | — | 0.26 |
| | | | | (0.70) | | (0.36) |
| 10 | Catechol | 0.75% | — | 0.23 | — | 0.12 |
| | | | (0.48) | (0.65) | | (0.58) |
| 11 | Pentane | 20% | 0.11 | 0.18 | — | 0.16 |
| | | | (0.84) | (1.40) | | (0.60) |
| 12 | Pentane | 10% | 0.21 | 0.42 | — | 0.18 |

*Solids content in brackets are on solvent/water free basis

TABLE 3A

EFFECT OF ADDITIVE CONCENTRATIONS WITH TIME ON RESIDUAL SOLIDS* IN LIQUOR D-1

| No. | Treating Agent | % Treating Agent | Time in Hours 0.25 | 0.5 | 1 | 2 | 4 | 6 | 24 | Remarks |
|---|---|---|---|---|---|---|---|---|---|---|
| | | | | (1.17) | (1.05) | (1.08) | (0.84) | | (0.66) | |
| 1 | Control | Nil | | 0.39 | 0.35 | 0.36 | 0.28 | | 0.22 | Bit. = 33.2% |
| | | | (1.11) | (0.99) | (0.84) | (0.75) | (0.63) | | (0.24) | |
| 2 | Formic Acid | 0.37 | 0.37 | 0.33 | 0.28 | 0.25 | 0.21 | | 0.08 | |
| | | | | (1.02) | | (0.69) | | | | |
| 3 | Formic Acid | 0.75 | | 0.34 | | 0.23 | | | | |
| | | | | (0.87) | | (0.30) | | (0.27) | | |
| 4 | Formic Acid | 1.5 | | 0.29 | | 0.10 | | 0.09 | | |
| | | | | (0.24) | | (0.15) | | | | |
| 5 | Formic Acid | 2.0 | | 0.08 | | 0.05 | | | | |
| | | | | | | (0.63) | | | | (Technical |
| 6 | Chloral Hydrate | 0.75 | | | | 0.21 | | | | Grade) |
| | | | | | | (0.36) | | | | |
| 7 | Chloral Hydrate | 1.5 | | | | 0.12 | | | | |
| | | | | (0.30) | | (0.18) | | | | |
| 8 | Chloral Hydrate | 2.0 | | 0.10 | | 0.06 | | | | |
| | | | | | (0.81) | (0.78) | (0.75) | (0.75) | (0.63) | (Technical |
| 9 | Resorcinol | 0.09 | | | 0.27 | 0.26 | 0.25 | 0.25 | 0.21 | Grade) |
| | | | | (0.96) | (0.84) | (0.78) | (0.69) | (0.60) | (0.30) | |

TABLE 3A-continued

EFFECT OF ADDITIVE CONCENTRATIONS WITH TIME ON RESIDUAL SOLIDS[x] IN LIQUOR D-1

| No. | Treating Agent | % Treating Agent | Time in Hours 0.25 | 0.5 | 1 | 2 | 4 | 6 | 24 | Remarks |
|---|---|---|---|---|---|---|---|---|---|---|
| 10 | Resorcinol | 0.19 | | 0.32 | 0.28 | 0.26 | 0.23 | 0.20 | 0.10 | |
| | | | | (0.87) | (0.69) | (0.21) | (0.12) | | | |
| 11 | Resorcinol | 0.37 | | 0.29 | 0.23 | 0.07 | 0.04 | | | |
| | | | (0.54) | (0.30) | (0.12) | (0.09) | | | | |
| 12 | Resorcinol | 0.75 | 0.18 | 0.10 | 0.04 | 0.03 | | | | |
| | | | (0.30) | (0.24) | (0.12) | (0.12) | | | | |
| 13 | Resorcinol | 1.5 | 0.10 | 0.08 | 0.04 | 0.04 | | | | |
| | | | | | (0.89) | (0.89) | (0.76) | (0.66) | (0.44) | (Technical |
| *14 | P.E. 30-60 | 5.0 | | | 0.28 | 0.28 | 0.24 | 0.21 | 0.14 | Grade) |
| | | | | (1.03) | (0.70) | (0.63) | | (0.50) | (0.36) | |
| 15 | P.E. 30-60 | 10.0 | | 0.31 | 0.21 | 0.19 | | 0.15 | 0.11 | |
| | | | | (1.00) | (0.50) | (0.23) | | | | |
| **16 | P.E. 30-60 | 10.0 | | 0.22 | 0.11 | 0.05 | | | | Bit. = 24.1% |
| | | | | (1.00) | (0.52) | (0.52) | | (0.48) | (0.35) | |
| 17 | P.E. 30-60 | 15.0 | | 0.29 | 0.15 | 0.15 | | 0.14 | 0.10 | |
| | | | | (0.65) | (0.47) | (0.32) | (0.22) | (0.14) | | |
| 18 | P.E. 30-60 | 20.0 | | 0.18 | 0.13 | 0.09 | 0.06 | 0.04 | | |
| | | | | (0.31) | (0.24) | | | | | |
| 19 | P.E. 30-60 | 30.0 | | 0.08 | 0.06 | | | | | |
| | | | (0.13) | (0.08) | | | | | | |
| 20 | P.E. 30-60 | 40.0 | 0.03 | 0.02 | | | | | | |
| | | | | (1.08) | (0.95) | (0.79) | (0.57) | (0.25) | | |
| 21 | P.E. + Resorcinol | 5.0 / 0.09 | | 0.34 | 0.30 | 0.25 | 0.18 | 0.08 | | |
| | | | (0.36) | (0.26) | (0.17) | (0.10) | (0.13) | | | |
| 22 | P.E. + Resorcinol | 10.0 / 0.19 | 0.11 | 0.08 | 0.05 | 0.03 | 0.04 | | | |
| | | | (1.13) | (0.93) | (0.70) | (0.46) | (0.46) | (0.26) | (0.10) | |
| 23 | P.E. + Formic Acid | 10.0 / 0.09 | 0.34 | 0.28 | 0.21 | 0.14 | 0.14 | 0.08 | 0.03 | |
| | | | (0.30) | (0.10) | | | | | | |
| 24 | P.E. + Formic Acid | 10.0 / 0.19 | 0.09 | 0.03 | | | | | | |
| | | | (0.40) | (0.26) | (0.13) | | | | | |
| 25 | P.E. + Chloral Hydrate | 10.0 / 0.19 | 0.12 | 0.08 | 0.04 | | | | | |
| | | | | (0.40) | (0.20) | (0.17) | | | | |
| | P.E. + Acrylic Acid | 10.0 / 0.19 | | 0.12 | 0.06 | 0.05 | | | | |
| | | | | | (0.83) | (0.70) | | | | |
| 27 | P.E. + Poly-Acrylic Acid | 10.0 / 0.19 | | | 0.25 | 0.21 | | | | (M.W. 6000) |
| | | | | (0.46) | (0.30) | (0.20) | (0.10) | | | |
| 28 | P.E. + Acetic Acid | 10.0 / 0.19 | | 0.14 | 0.09 | 0.06 | 0.03 | | | |
| | | | | (0.56) | (0.33) | (0.20) | (0.13) | | | |
| 29 | P.E. + Lactic Acid | 10.0 / 0.19 | | 0.17 | 0.10 | 0.06 | 0.04 | | | |
| | | | | (0.83) | (0.53) | | | | (0.17) | |
| 30 | P.E. + Methyl Alcohol | 10.0 / 0.19 | | 0.25 | 0.16 | | | | 0.05 | |

*PE = Petroleum ether, boiling point range 30 to 60° C.
**SESA Process Liquor D-2 (24.1% Bitumen)
[x]Residual solids in brackets based on bitumen content of suspensions.

TABLE 3B

EFFECT OF ADDITIVE CONCENTRATIONS WITH TIME ON RESIDUAL SOLIDS[+] IN LIQUOR S.B.-D.*

| No. | Treating Agent | % Treating Agent | Time in Hours 0.25 | 0.5 | 1 | 2 | 4 | 6 | 24 | Remarks |
|---|---|---|---|---|---|---|---|---|---|---|
| | | | | | (3.44) | | | (3.00) | (2.81) | |
| 31 | (Control) | Nil | | | 1.1 | | | 0.96 | 0.90 | 32% Bitumen |
| | | | (0.25) | (0.15) | | | | | | |
| 32 | P.E. | 60 | 0.05 | 0.03 | | | | | | |

TABLE 3B-continued

EFFECT OF ADDITIVE CONCENTRATIONS WITH TIME ON RESIDUAL SOLIDS+ IN LIQUOR S.B.-D.*

| No. | Treating Agent | % Treating Agent | Time in Hours 0.25 | 0.5 | 1 | 2 | 4 | 6 | 24 | Remarks |
|---|---|---|---|---|---|---|---|---|---|---|
| 33 | P.E. | 50 | | (0.47) 0.10 | (0.23) 0.05 | | | | | |
| 34 | Formic Acid | 3.0 | | (2.53) 0.81 | | | (1.19) 0.38 | (0.47) 0.15 | | (Additive as 70% Sol.) |
| 35 | Chloral Hydrate | 3.0 | | (2.31) 0.74 | | | | (0.09) 0.03 | | (Additive as 70% Sol.) |
| 36 | Resorcinol | 1.5 | | (1.34) 0.43 | (0.28) 0.09 | | | | | (Additive as 70% Sol.) |

*S.B.-D. = SYNCRUDE HOT WATER Bitumen Concentrate, diluted, partially dewatered and partially demineralized.
+Residual solids in brackets based on bitumen content of suspensions.

TABLE 4

RESIDUE COMPOSITION - SESA PRODUCT D-1

| No. | Additive | % Additive | Residue % Original Liquor W/W % | RESIDUE COMPOSITION Solids Content W/W % | Water Content W/W % | Organic Content W/W % | Asphaltene Content W/W % | ASPHALTENE* PARTITION % Residue | Liquor |
|---|---|---|---|---|---|---|---|---|---|
| 1 | Control (Centrifuged) | — | 1.7 | 30.6 | 21.7 | 47.7 | 7.1 | 2.0 | 98.0 |
| 2 | P.E.x | 40 | 6.1 | 8.5 | 6.1 | 85.4 | 32.0 | 31.9 | 68.1 |
| 3 | P.E. | 20 | 4.9 | 10.6 | 7.5 | 81.9 | 25.5 | 20.5 | 79.5 |
| 4 | Resorcinol | 0.75 | 4.6 | 11.3 | 23.7 | 65.0 | 5.4 | 4.1 | 95.9 |
| 5 | P.E.<br>Acetic Acid | 10<br>0.19 | 3.4 | 15.3 | 16.5 | 68.2 | 13.7 | 7.7 | 92.3 |
| 6 | P.E.<br>Lactic Acid | 10<br>0.19 | 4.2 | 12.4 | 13.3 | 74.3 | 12.9 | 8.8 | 91.2 |
| 7 | P.E.<br>Formic Acid | 10<br>0.19 | 3.7 | 14.0 | 15.1 | 70.9 | 11.6 | 7.0 | 93.0 |

*Asphaltene content in original liquor = 6.1%

I claim:

1. A process for reducing the content of fine hydrophobic solids of solvent-diluted materials selected from petroleum oils, bitumen solutions or concentrates, shale oil, and heavy crude oils, said materials having fine hydrophobic solids present, comprising:

(i) (a) in the case of asphaltene-containing materials dispersing an asphaltene-precipitating solvent and optionally a concentrated aqueous solution of an additive selected from the group consisting of resorcinol, catechol, formic acid, maleic acid or anhydride, chloral hydrate and mixtures thereof, throughout said materials, (b) in the case of such asphaltene-free materials dispersing a concentrated aqueous solution of an additive selected from the group consisting of resorcinol catechol, formic acid, maleic acid or anhydride, chloral hydrate and mixtures thereof throughout said materials, the amounts dispersed in (a) and (b) and the amounts of water present being sufficient to cause the formation of small agglomerates comprising the hydrophobic solids, (ii) agitating to form agglomerates of the hydrophobic solids, and (iii) removing the agglomerated solids from the residual material.

2. The process of claim 1 wherein the feed material is selected from a tar sand solvent extraction liquor, a bitumen concentrate from tar sand hot water processes, a heavy oil, and an oil obtained from enhanced oil recovery techniques.

3. The process of claim 1 wherein the feed material contains asphaltenes, asphaltene-precipitating solvents are included, and the agglomerated solids include precipitated asphaltenes.

4. The process of claim 3 wherein the feed material is a tar sand solvent extraction-solids agglomeration process liquor with the tar sand hydropholic solids removed but still containing fine intractable hydrophobic solids.

5. The process of claim 3 wherein in addition to an asphaltene-precipitating solvent, at least one of the other six additives in said group is utilized to enhance agglomeration.

6. The process of claim 3 wherein oils and bitumen solutions or concentrates containing asphaltenes are treated and in addition to an asphaltene-precipitating solvent, a polar organic additive selected from acrylic acid, acetic acid and lactic acid is utilized to enhance agglomeration.

7. The process of claim 1 wherein the amount of the additive used is within the range of about 0.2 to about 3% w/w based on the feed material, except for asphaltene-precipitating solvent which is within the range of about 5 to about 40%.

8. The process of claim 1 wherein the asphaltene-precipitating solvent is selected from petroleum ether, pentane, hexane and low boiling paraffinic refinery product mixtures.

9. The process of claim 3 wherein the asphaltene-precipitating solvent is separated from the residual liquid and recycled.

10. The process of claim 1 wherein the feed materials have previousy been treated to remove hydrophilic solids, leaving intractable hydrophobic solids present.

11. A process for reducing the fine hydrophobic solids content of solvent-diluted materials selected from petroleum oils, bitumen solutions or concentrates, and heavy crude oils, said materials containing asphaltenes, comprising:

(i) disposing an asphaltene-precipitating solvent and an aqueous solution of a polar additive selected from acrylic acid, acetic acid and lactic acid, throughout said materials the amount of the precipitating solvent, of water and of the additive being sufficient to cause the formation of small agglomerates of the hydrophobic solids, (ii) agitating to form agglomerates of the hydrophobic solids, and (iii) removing the agglomerated solids from the residual material.

* * * * *